US007211010B2

(12) United States Patent
Lin et al.

(10) Patent No.: US 7,211,010 B2
(45) Date of Patent: May 1, 2007

(54) REINFORCING MEMBER FOR A BADMINTON RACQUET

(75) Inventors: Mark W. Lin, Hinsdale, IL (US); William D. Severa, Darien, IL (US)

(73) Assignee: Wilson Sporting Goods Co., Chicago, IL (US)

( * ) Notice: Subject to any disclaimer, the term of this patent is extended or adjusted under 35 U.S.C. 154(b) by 40 days.

(21) Appl. No.: 11/219,129

(22) Filed: Sep. 3, 2005

(65) Prior Publication Data

US 2007/0054761 A1 Mar. 8, 2007

(51) Int. Cl.
*A63B 49/02* (2006.01)

(52) U.S. Cl. ..... 473/546; 473/537

(58) Field of Classification Search ..... 473/524, 473/546, 537

See application file for complete search history.

(56) References Cited

U.S. PATENT DOCUMENTS

| | | | | |
|---|---|---|---|---|
| 4,192,505 | A | | 3/1980 | Tabickman et al. |
| 4,360,202 | A | | 11/1982 | Lo |
| 4,575,084 | A | | 3/1986 | Yoneyama |
| 4,989,871 | A | | 2/1991 | Sheng |
| 5,006,298 | A | | 4/1991 | Tsai |
| 5,071,124 | A | * | 12/1991 | Davis ..... 473/537 |
| 5,344,139 | A | | 9/1994 | Wu |
| 5,935,028 | A | | 8/1999 | Lo |
| 6,623,383 | B2 | | 9/2003 | Matsuoka et al. |

FOREIGN PATENT DOCUMENTS

| | | | | |
|---|---|---|---|---|
| DE | 297 01 044 U1 | | | 5/1997 |
| EP | 0 456 407 B1 | | | 11/1991 |
| EP | 1 388 354 A1 | | * | 2/2004 |
| GB | 1423046 | | | 1/1976 |
| GB | 2 026 327 | | | 2/1980 |
| GB | 2 037 168 A | | * | 7/1980 |
| GB | 2 076 295 | | | 12/1981 |
| GB | 2076 295 A | | | 12/1981 |
| GB | 2 136 695 A | | | 9/1984 |
| GB | 2 148 722 | | | 6/1985 |
| GB | 2 151 492 | | | 7/1985 |
| GB | 2 282 974 A | | * | 4/1995 |
| JP | P2004-65862 A | | * | 3/2004 |

* cited by examiner

*Primary Examiner*—Raleigh W. Chiu
(74) *Attorney, Agent, or Firm*—Terence P. O'Brien

(57) ABSTRACT

A reinforcing member for a badminton racquet wherein the racquet extends along a longitudinal axis and includes a frame having a tubular hoop portion supporting a string bed and a tubular handle portion. The reinforcing member includes a generally T-shaped body having first and second sections. The first section has an outer surface that defines a first cross-sectional area measured about a longitudinal plane positioned generally perpendicular to the string bed. The second section longitudinally and outwardly extends from the first section. The second section has an outer surface that defines a second cross-sectional area measured about a transverse plane. The first cross-sectional area is at least 50 percent greater than the second cross-sectional area. The first and second sections are configured for placement within the hoop and handle portions of the frame, respectively.

28 Claims, 7 Drawing Sheets

REINFORCING MEMBER FOR A BADMINTON RACQUET

FIELD OF THE INVENTION

The present invention relates generally to a badminton racquet. In particular, the present invention relates to a reinforcing member for improving the coupling of the hoop and handle portions of the badminton racquet frame.

BACKGROUND OF THE INVENTION

Badminton racquets are well known and typically include a tubular head portion attached to a tubular handle portion. The head portion forms a hoop supporting a latticework of tensioned strings. The latticework of strings is commonly referred to as a string bed and includes a plurality of intersecting cross and main string segments, which attach to the head portion. The handle portion downwardly and outwardly extends from a lower portion of the head portion to form a generally T-shaped connection region. The handle portion typically includes a handle attached to the proximal end of the handle portion. The handle is covered by a grip.

There is a continuing desire to increase the performance, responsiveness and control of the racquet, and to improve the strength and durability of the connection region of head and handle portions. Badminton racquets must provide players with the ability to complete high-speed swing actions to bat a shuttlecock at short intervals in a relatively small court space compared with, for example, the game of tennis. The speed of the game necessitates that a badminton racket be constructed to be light in weight and have satisfactory resilience for easy handling. Furthermore, in order to satisfy the need for a high-speed swing action, the dimensions of the badminton racket in the swing direction must be minimized. Such configurations maintain the moment of inertia and air resistance of the badminton racquet at desirable levels. It is also necessary that the racquet possess high mechanical strength in order withstand the stress of a high-speed swing as well as various impact loads arising from the use of the racquet. It can be very difficult to reliably satisfy all of these design requirements. For example, a badminton that is light weight, highly resilient and provides minimum air resistance may also have very low mechanical strength.

The cross-sectional size of the handle portion of a badminton racquet is generally quite small compared to that of other racquet sport racquets such as tennis or racquetball. The cross-sectional size of the head portion of a badminton racquet is also smaller than that of other sports racquets. Also, the head portion typically connects to the handle portion at a single location as opposed to two or more locations commonly used with tennis racquets. This single connection point provides badminton racquets with a high level of flexibility. Although flexibility in some aspects of the racquet is desired, such as in the swing direction, a highly torsionally flexible racquet, or a racquet with a reduced resistance to torsional bending, is undesirable because it can lead to poor control, reduced accuracy and lower performance. Further, the relatively small size of the head and handle portions place a large amount of stress on the single connection region of the head and handle portions. As a result, it is not uncommon for badminton racquets to prematurely fail at the connection region.

In an effort to address the premature failure issue, some existing badminton racquets have included T-shaped joints at the connection between the head and handle portions.

These joints typically include an elongate vertical joint section that extends a significant distance into the handle portion of the racquet. As a result, the length, and the cross-sectional size, of the joint section within the handle member is typically as large, or larger, than the length, and the cross-sectional size, of the joint section positioned within the head portion of such racquets. The rather large size of the existing T-shaped joints can negatively effect the weight of the racquet and, as a result, the playability of the racquet. Further, the elongate extension into the handle portion of the racquet can stiffen, and reduce the flexibility of, the racquet, particularly in the swing direction. Such stiffening is undesirable because it can decrease the responsiveness and playability of the racquet.

Thus, there is a continuing need for a badminton racquet that is highly durable and reliable, but also provides the desired level of performance and playability. What is needed is an improved racquet design that inhibits premature failure without negatively affecting the overall weight of the badminton racquet. What is also needed is a durable badminton racquet with desired responsiveness, particularly in the swing direction. Further, it would be advantageous to provide a durable racquet with high playability that can be efficiently and reliably produced.

SUMMARY OF THE INVENTION

The present invention provides a reinforcing member for a badminton racquet wherein the racquet extends along a longitudinal axis and includes a frame having a tubular hoop portion supporting a string bed and a tubular handle portion. The reinforcing member includes a generally T-shaped body having first and second sections. The first section has an outer surface that defines a first cross-sectional area measured about a longitudinal plane positioned generally perpendicular to the string bed. The second section longitudinally and outwardly extends from the first section. The second section has an outer surface that defines a second cross-sectional area measured about a transverse plane. The first cross-sectional area is at least 50 percent greater than the second cross-sectional area. The first and second sections are configured for placement within the hoop and handle portions of the frame, respectively.

According to a principal aspect of the invention, a badminton racquet includes a frame having a tubular hoop portion and a tubular handle portion, a string bed, and a generally T-shaped reinforcing member. The string bed is supported by the hoop portion. The first section has an outer surface that defines a first cross-sectional area measured about a longitudinal plane positioned generally perpendicular to the string bed. The second section longitudinally and outwardly extends from the first section. The second section has an outer surface that defines a second cross-sectional area measured about a transverse plane, the first cross-sectional area being at least 50 percent greater than the second cross-sectional area. The first and second sections are configured for placement within the hoop and handle portions of the frame, respectively.

According to another principal aspect of the invention, a badminton racquet extends along a longitudinal axis is configured for impacting a shuttlecock and for placement within a test support for a racquet torsional stability test. The racquet includes a frame, a string bed and a generally T-shaped reinforcing member. The frame includes a tubular hoop portion defining a hoop and a tubular handle portion. The frame has a head size of approximately 54.5 inches$^2$. The handle portion has a distal end region having an outside diameter within the range of 6.75 mm to 7.25 mm. The string bed is supported by the hoop portion. The racquets has a strung weight within the range of 88.0 to 93.5 grams. The reinforcing member includes first and second sections configured for placement within the hoop and handle portions of the frame, respectively. The second section longitudinally and outwardly extends from the first section. The racquet has a torsional deflection of less than 10.5 degrees when measured in a torsional stability test wherein the handle portion is fixedly supported by the test support, and the shuttlecock travels at an incoming velocity of approximately 34 miles per hour and impacts the string bed at a location approximately 1.25 inches to the left or right of a geometric center of the hoop portion.

This invention will become more fully understood from the following detailed description, taken in conjunction with the accompanying drawings described herein below, and wherein like reference numerals refer to like parts.

DETAILED DESCRIPTION OF THE PREFERRED EMBODIMENTS

Figure 1:
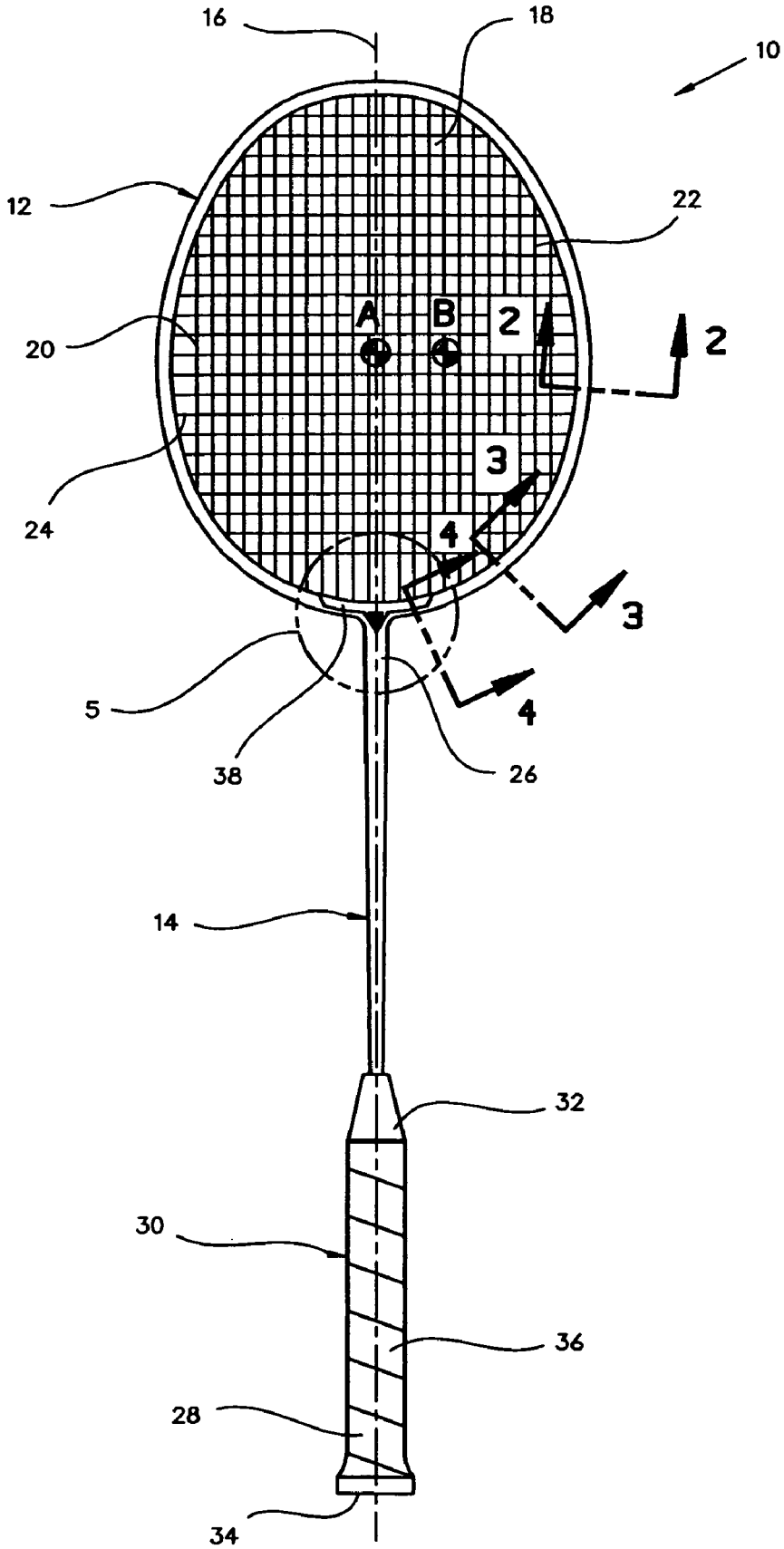
FIG. 1 is a front perspective view of a badminton racquet in accordance with a preferred embodiment of the present invention.

Referring to FIG. 1, a badminton racquet is indicated generally at 10. The racquet 10 includes a frame having a hoop portion 12 and a handle portion 14 outwardly extending from the hoop portion 12 along a longitudinal axis 16 of the racquet 10. The head portion 12 is a curved tubular structure preferably defining a generally oval shaped opening 18 for supporting a substantially planar latticework of strings in tension, also referred to as a string bed 20. In alternative preferred embodiments, the opening formed by the head portion 12 can be generally tear drop shaped or generally circular. The head portion 12 is coupled to the handle portion 14. In one preferred embodiment, the head portion 12 is integrally formed with the handle portion 14.

The head and handle portions 12 and 14 are formed of a lightweight, flexible and durable material, preferably a carbon-fiber composite material. Alternatively, the head and handle portions 12 and 14 can be formed of other materials, such as, for example, other non-carbon fiber composite materials, aluminum, metallic alloys, thermoplastic materials, thermoset materials, and combinations thereof. The racquet 10 preferably has an unstrung weight in the range of approximately 79.0–95.0 grams, and a strung weight of approximately 82.0–98.0 grams. In a particularly preferred embodiment, the strung weight of the racquet is within the range of 89.0–92.0 grams. In alternative preferred embodiments, the racquet can be formed of a weight below or above the above-listed weight ranges.

The head portion 12 preferably includes a plurality of string holes (not shown) for receiving and supporting the string bed 20. The string bed 20 is formed by a plurality of main string segments 22 interwoven with a plurality of cross string segments 24. The main string segments 22 extend across the opening 18 in a direction generally parallel to the axis 16, and the cross string segment extend across the opening 18 in a direction generally perpendicular, or transverse, to the longitudinal axis 16. The head portion 12 has a geometric center indicated as point A. The head size of the racquet, or the size of the string bed 20, can be within the range of 48.0 to 60.0 $in^2$. In one preferred embodiment, the head size of the racquet can be within the range of 54.0 to 56.0 $in^2$, and in a particularly preferred embodiment, the head size is approximately 54.5 $in^2$. Alternative head sizes can also be used, such as approximately 60.0 $in^2$.

The handle portion 14 is an elongate tubular member having distal and proximal end regions 26 and 28. The distal end region 26 of the handle portion 14 is preferably directly connected to the hoop portion 14. The distal end region 26 of the handle portion 14 preferably has an outer diameter in the range of 6–10 mm. In one particularly preferred embodiment, the outer diameter of the distal end region 26 is within the range of 6.75 to 8.0 mm. In another particularly preferred embodiment, the outer diameter of the distal end region 26 is within the range of 6.75 to 7.25 mm. In yet another particularly preferred embodiment, the outer diameter of the distal end region 26 is within the range of 6.95 to 7.05 mm. In another preferred embodiment, the outer diameter of the proximal end region can be approximately 7.5 mm.

The handle grip assembly 30 is attached to the proximal end region 28 of the handle portion 14. The handle portion 14 spaces apart the grip assembly from the head portion 12 providing the racquet with the desired length. The handle grip assembly is configured for grasping by a user, and preferably includes a pallet 32, a butt cap 34, and a grip 36. The pallet 32 is a tubular member configured to slide over the outer surface of the proximal end region 28 of the handle portion 14, or to attach to the proximal end region 28. Alternatively, the pallet can be integrally formed with the handle portion. The butt cap 34 is a protective member, which generally covers the proximal end of the handle portion 14 and the pallet 32. The grip 36 is an elongate strip of material that substantially covers the pallet 32 and at least a portion of the butt cap 34.

Figure 2:
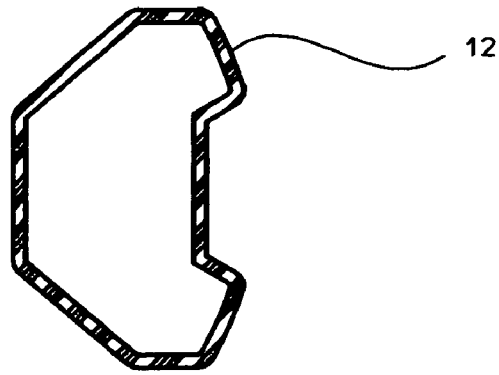
FIG. 2 is a cross-sectional view of the head portion of the frame taken along line 2—2 of FIG. 1.
Figure 3:
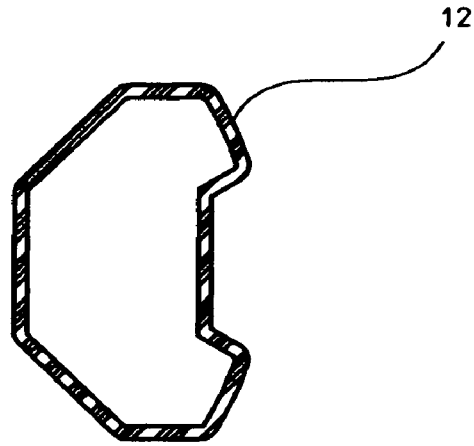
FIG. 3 is a cross-sectional view of the head portion of the frame taken along line 3—3 of FIG. 1.
Figure 4:
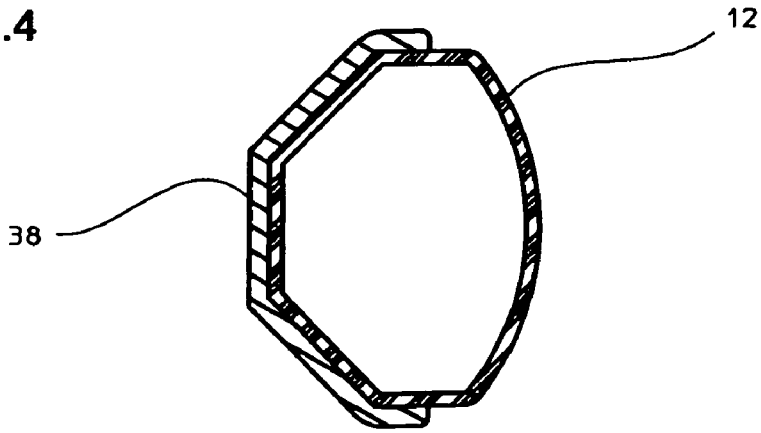
FIG. 4 is a cross-sectional view of the head portion of the frame taken along line 4—4 of FIG. 1.

Referring to FIGS. 1–4, the head portion 12 is shown in greater detail. The tubular head portion 12 preferably gradually increases in size from a mid-section of the head portion 12 (see FIG. 2) toward the lower section. FIGS. 2–4 illustrate the increase in the size and the outer cross-sectional area of the head portion at three different locations. In an alternative preferred embodiment, the size of the head portion 12 can remain generally constant along the middle and lower sections of the head portion 12. Referring to FIGS. 1 and 4, in a particularly preferred embodiment, a decorative cover 38 is secured to the upper portion of the lower end of the head portion 12. The cover 38 provides the racquet 10 with a unique aesthetic design and can also be employed to increase the structural integrity of the head portion 12.

Figure 5:
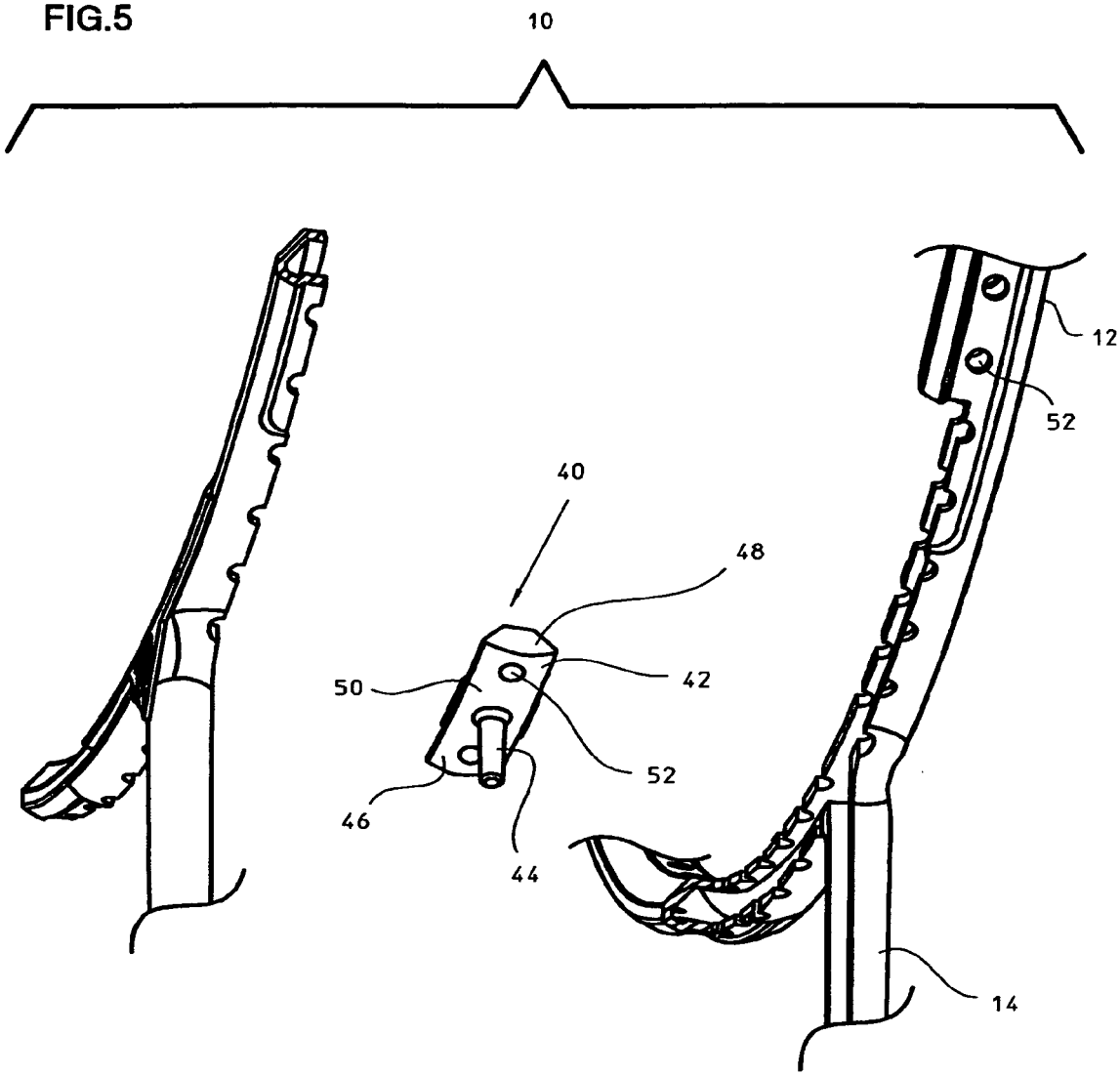
FIG. 5 is an exploded view of a portion of the badminton racquet of FIG. 1 without racquet string.
Figure 6:
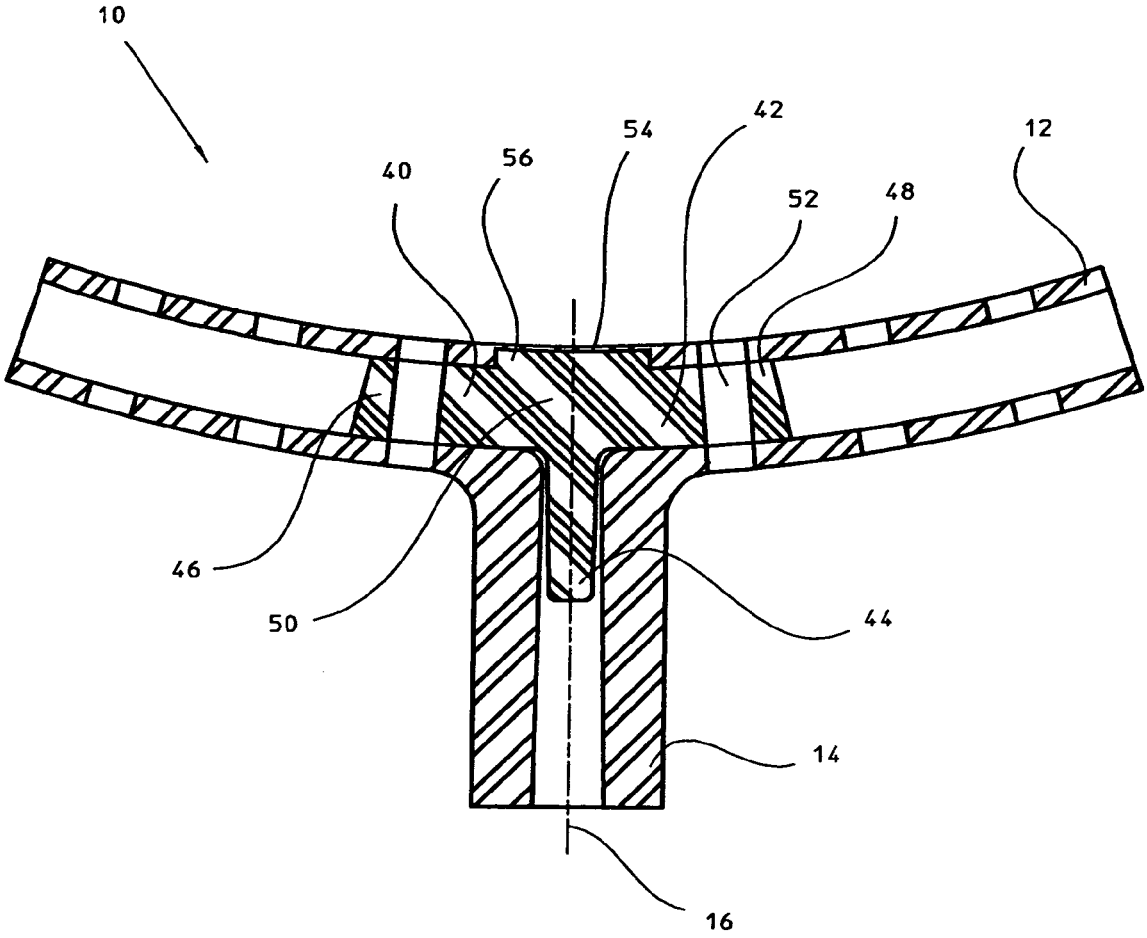
FIG. 6 is a longitudinal cross-sectional view of a portion of the badminton racquet of FIG. 1 without racquet string.
Figure 7:
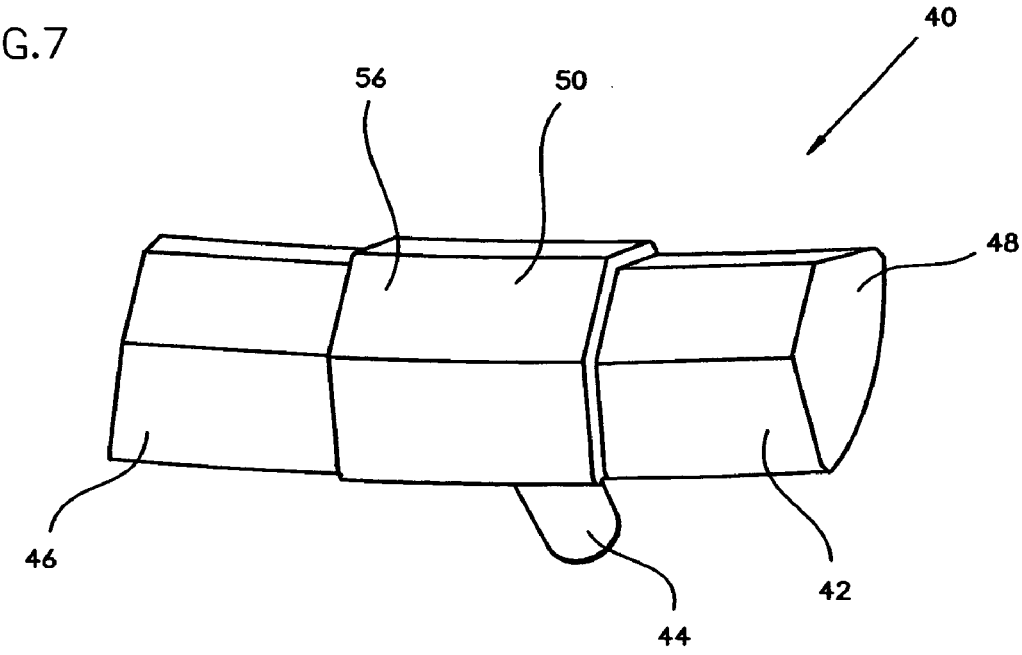
FIG. 7 is a top perspective view of a reinforcing member of the badminton racquet of FIG. 1 prior to assembly.
Figure 8:
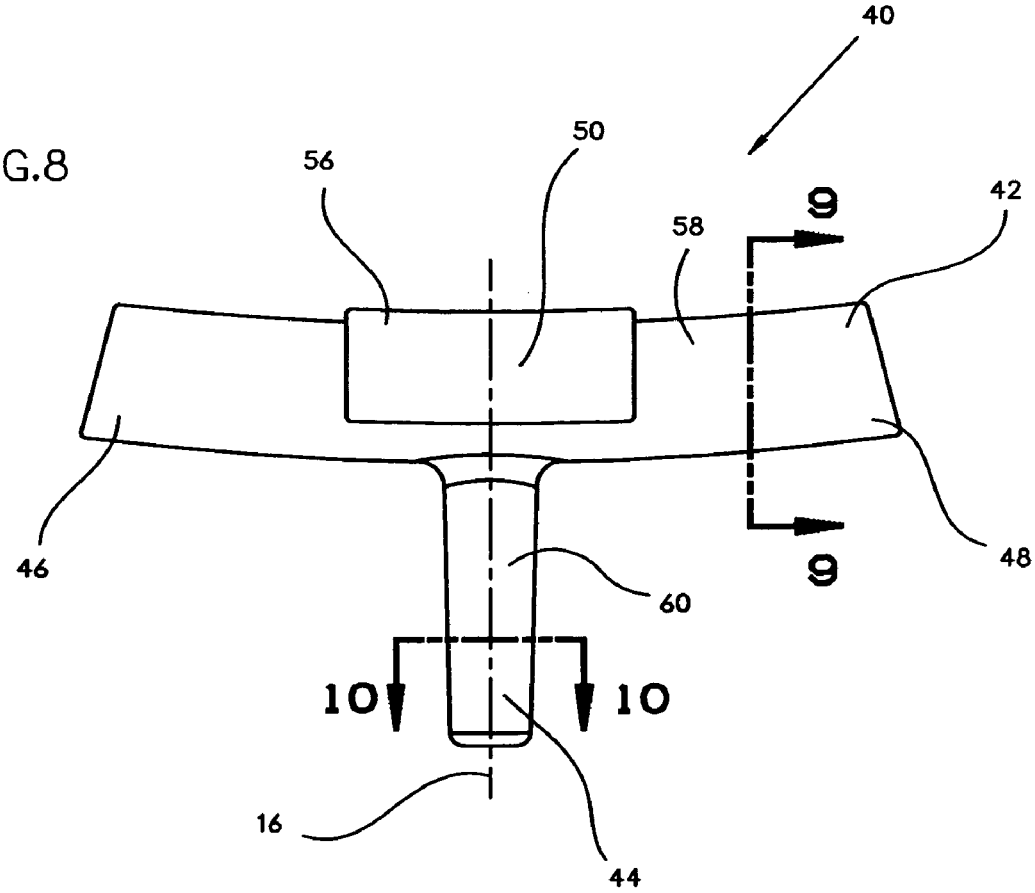
FIG. 8 is a side view of the reinforcing member of FIG. 7.

Referring to FIGS. 5 and 6 the juncture of the head and handle portions 12 and 14 is shown in greater detail. The head and handle portions 12 and 14 are preferably integrally formed or connected to each other. A generally T-shaped reinforcing member 40 is preferably positioned within the frame at the juncture of the head and handle portions 12 and 14. The reinforcing member 40 is formed of a strong, lightweight material, preferably a carbon-fiber composite material. Alternatively, the head and handle portions 12 and 14 can be formed of other materials, such as, for example, other non-carbon fiber composite materials, aluminum, metallic alloys, polyurethane, nylon, other thermoplastic materials, other thermoset materials, wood, and combinations thereof.

The reinforcing member 40 has a generally T-shaped body including first and second sections 42 and 44. The first section 42 is configured for placement within the lower end of the head portion 12 and thus extends generally transverse to the longitudinal axis 16. The second section 44 outwardly and downwardly extends from a lower surface of the first section 42, and is configured for placement within the distal end region 26 of the handle portion 14. The second section 44 extends generally parallel with the axis 16. The reinforcing member 40 is preferably formed as a solid continuous member. Alternatively, one or both of the first and second sections 42 and 44 can be hollow. In another alternative embodiment, the reinforcing member 40 can be formed of two or more sub-members connected together to form the reinforcing member 40.

The first section 42 includes left and right projecting ends 46 and 48 outwardly extending from a central segment 50. A plurality of string holes 52 are formed into the head portion 12, and, preferably, two spaced apart string holes 52 are also formed into the first section 42 (one in each of the left and right projecting ends 46 and 48). The string holes 52 enable racquet string to extend through and around the head portion 12 to form and support the string bed 22.

Referring to FIG. 6, the head portion 12 preferably includes a recess 54 formed into an inner surface of an upper segment of the lower end of the head portion 12. The recess 54 is advantageously sized to receive a ledge 56 upwardly and outwardly extending from the central segment 50 of the first section 42 of the reinforcing member 40. Preferably, the ledge 56 substantially fills the recess 54. The engagement of the ledge 56 with the lower end of the head portion 12 facilitates and helps ensure the proper centering of the reinforcing member 40 within the frame of the racquet 10.

Figure 9:
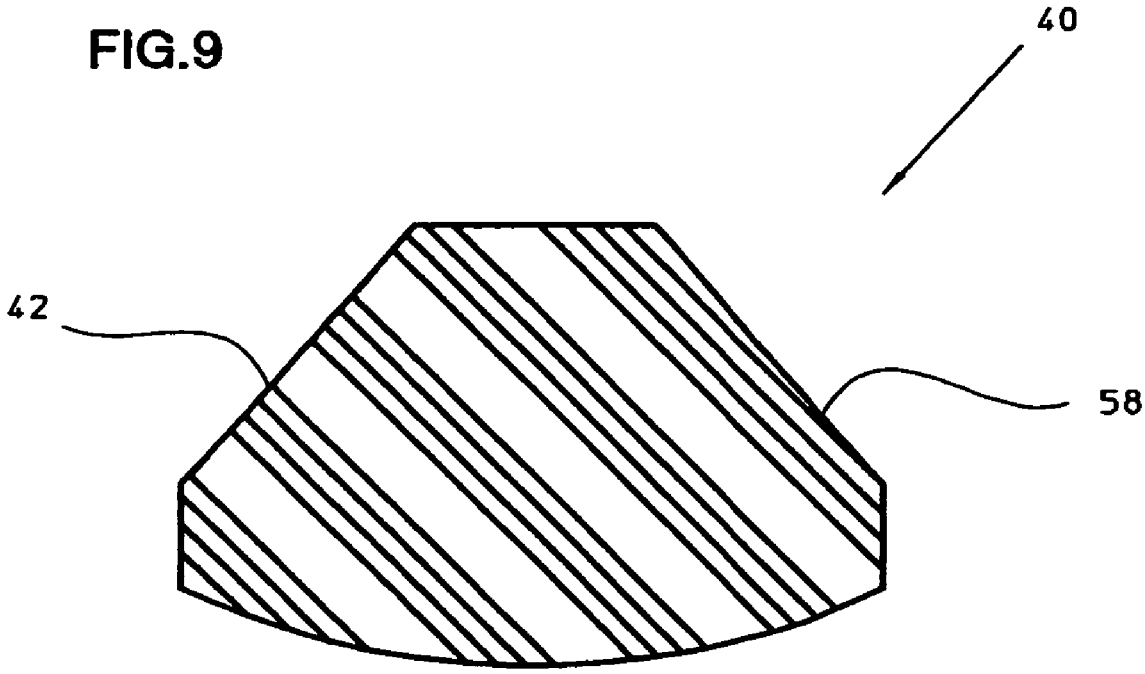
FIG. 9 is a longitudinal cross-sectional view of the reinforcing member taken along line 9—9 of FIG. 8.
Figure 10:
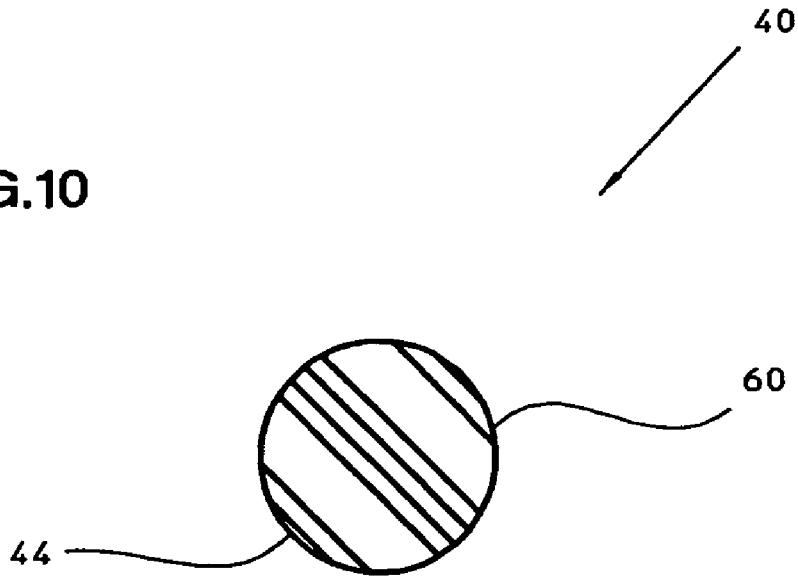
FIG. 10 is a transverse cross-sectional view of the reinforcing member taken along line 10—10 of FIG. 8.

Referring to FIGS. 6–10, the reinforcing member 40 is shown in greater detail. The first section 42 is configured to be greater in size than the second section 44. Each of the left and right projecting ends of the first section 42 of the reinforcing member has an outer surface 58 defining a first cross-sectional area measured about a longitudinal plane positioned generally perpendicular to a plane defined by the string bed 22 (as seen in FIG. 9). The second section 44 of the reinforcing member 40 has an outer surface 60 that defines a second cross-sectional area measured along a transverse plane (as seen in FIG. 10). In one preferred embodiment, the first cross-sectional area is at least 50 percent greater than the second cross-sectional area. In a particularly preferred embodiment, the first cross-sectional area is at least 100 percent greater than the second cross-sectional area, and in another particularly preferred embodiment, the first cross-sectional area is at least 150 percent greater than the second cross-sectional area.

Further, the length of the first section 42 measured from the left projecting end 46 to the right projecting end 48 is significantly greater than the length of the second section 44, measured along the longitudinal axis 16. In one preferred embodiment, the length of the first section 42 is at least 30 percent greater than the length of the second section 44. In a particularly preferred embodiment, the length of the first section 42 is at least 50 percent greater than the length of the second section 44, and in another particularly preferred embodiment, the length of the first section 42 is at least 80 percent greater than the length of the second section 44.

In one preferred embodiment, the first cross-sectional area is within the range of 24 to 34 $mm^2$, and the second cross-sectional area is within the range of 5 to 10 $mm^2$. In one particularly preferred embodiment, the first cross-sectional area is in the range of 27 to 31 $mm^2$, and the second cross-sectional area is in the range of 7 to 8 $mm^2$. The first section 42 has a length within the range of 18 to 24 mm, and the second section 44 has a length within the range of 4 to 10 mm. In one particularly preferred embodiment, the first section 42 has a length within the range of 21 to 23 mm, and the second section 44 has a length within the range of 8 to 9 mm. In alternative preferred embodiments, other dimensions for the first and second cross-sectional areas and the length of the first and second sections can be used.

The reinforcing member 40 strengthens the connection between the head and handle portions 12 and 14 of the racquet 10 thereby improving the reliability and durability without negatively affecting the performance and playability of the racquet. By reducing the size and length of the second section 44 relative to the first section 42, unnecessary weight is eliminated from the reinforcing member, and the flexibility of the racquet in the swing direction is not negatively affected.

The reinforcing member 40, with the enlarged first section 42, significantly improves the torsional stability and torsional strength of the racquet 10 over conventional badminton racquets. The increased torsional stability improves the control and playability of the racquet 10. The torsional stability of the racquet 10 can be tested in a badminton racquet high speed video impact test.

Figure 11:
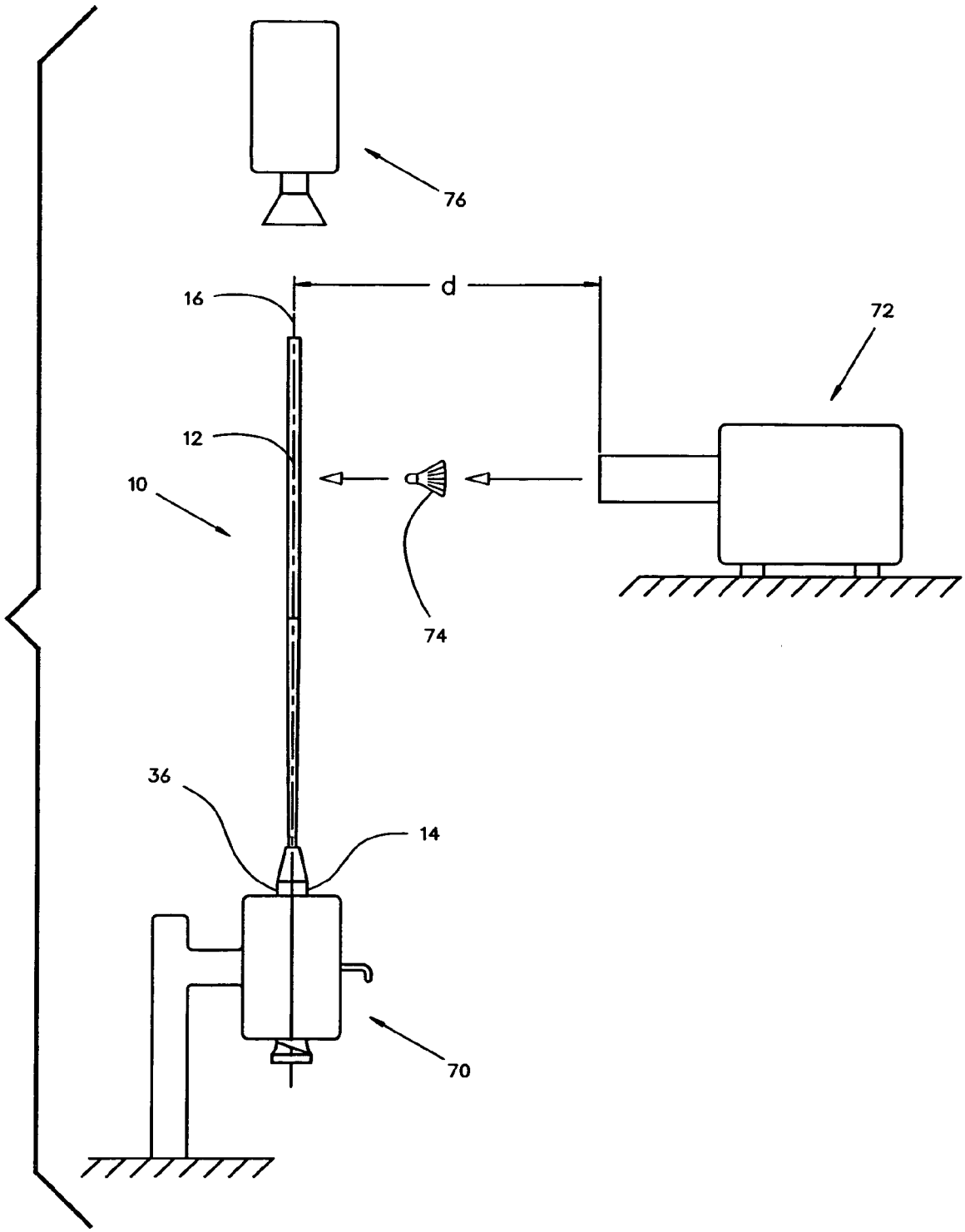
FIG. 11 is a side view of a torsional stability test assembly including a shuttlecock projected toward a badminton racquet.

Referring to FIG. 11, the ability of a racquet to resist torsional bending is demonstrated through a torsional stability test wherein the handle portion 14 is secured in a test stand 70 at the grip 36. Once secured, the racquet 10 is positioned such that the longitudinal axis 16 of the racquet is vertical with the handle portion 14 positioned below the hoop portion 12. An air cannon 72, such as the Model No. 101 by Lobster Sports, Inc. of Toluca, Calif., is positioned to project or launch a shuttlecock 74 along a trajectory such that the shuttlecock 74 impacts the string bed from a direction that is perpendicular to the string bed, cap end forward, and at a location that is approximately 1.25 inches to the right or left of the geometric center of the string bed defined by the hoop portion of the racquet (see location B on FIG. 1). The air cannon is positioned approximately two feet from the head portion of the racquet (distance d of FIG. 11) and projects the shuttlecock 74 such that the shuttlecock 74 impacts the string bed at a speed of approximately 34 miles per hour.

A high speed video machine 76, such as Model HS-4, from Motion Pro of San Diego, Calif., is positioned above the racquet and directed to view the top of the racquet along the longitudinal axis of the racquet. The high speed video machine collects images at a rate of 5000 frames per second and captures the shuttlecock and the racquet before, during and after the impact. The high speed video machine enables the speed of the shuttlecock to be determined as well as the amount of torsional and longitudinal bending of the racquet in response to the impact with the shuttlecock.

During testing, the racquet and air cannon are positioned as described above. A shuttlecock is launched from the air cannon with its cap end forward into the string bed 22 at an incoming velocity of approximately 34 miles per hour. When viewed from the direction of the air cannon, the shuttle cock is launched to impact the contact the racquet at approximately 1.25 inches to the right (or left) of the geometric center of the string bed. The high speed video camera records the amount of torsional and longitudinal deflection of the racquet in response to the impact of the shuttlecock.

A torsional stability test was performed on two different model badminton racquets. The first racquet, model Armortec™ 800 Offensive by Yonex Kabushiki Kaisha, is representative of a high performance badminton racquet including a generally conventional T-shaped joint support positioned within the racquet at the juncture of the head and handle portions. The first racquet has a strung weight of 90.8 grams and a head size of approximately 54.5 $in^2$. The distal end region of the handle portion of the first racquet has an outer diameter of approximately 7.0 mm. The second racquet, the Wilson® nCode® 1, is built in accordance with an embodiment of the present invention with a reinforcing member formed of carbon fiber composite material. The second racquet has a strung weight of approximately 90.8 grams, and a head size of approximately 54.5 $in^2$. The distal end region of the handle portion of the second racquet also has an outer diameter of approximately 7.0 mm.

A shuttlecock was projected from an air cannon positioned two feet from the string bed, dimension d from FIG. 11. The incoming velocity, longitudinal deflection and torsional deflection of the racquet were measured. Specifically, the torsional stability correlates to the degree of torsional deflection, or twisting, of the racquet in response to the impact with the shuttlecock. The torsional deflection or twisting is measured in degrees with respect to the longitudinal dimension of the racquet. The incoming velocity of the shuttlecock prior to impact with the first racquet, the Yonex Armotec 800, was 33.42 miles per hour, and the incoming velocity of the shuttlecock prior to impact with the second racquet, the Wilson® nCode® 1, was 33.82 miles per hour. The torsional deflection of the first racquet, the Yonex Armotec 800, was measured at 11.5 degrees, and the torsional deflection of the second racquet, the Wilson® nCode® 1, was measured at 9.3 degrees.

Accordingly, the torsional stability tests indicates that two badminton racquets having substantially the same strung weight and head size and with handle portions having substantially the same outside diameter at their distal end regions produce significantly different torsional stability results. Specifically, the torsional stability test indicates that the racquet built in accordance with an embodiment of the present invention, the Wilson® nCode® 1, is over 20 percent more torsionally stable than the racquet having a generally conventional T-shaped reinforcing member, the Yonex Armotec 800. The second racquet exhibited a torsional deflection of less than 10.5 degrees when measured in the torsional stability test. The torsional deflection of the second racquet was also less than 10.0 degrees and less than 9.5 degrees.

A racquet having a high level of torsional stability, such as a racquet of the present invention, will provide better control and improved accuracy over a racquet having a low level of torsional stability. A racquet having improved torsional stability will also generally provide the player with better feel and a more enjoyable playing experience.

The present invention provides for a racquet with improved durability and reliability without negatively affecting the performance, playability and maneuverability of the racquet. The present invention provides these benefits without negatively affecting the weight of the racquet and without negatively affecting the flexibility of the racquet in the swing direction. Further, the present invention can be readily produced without significantly increasing the complexity or cost of the racquet.

While the preferred embodiments of the present invention have been described and illustrated, numerous departures therefrom can be contemplated by persons skilled in the art. Therefore, the present invention is not limited to the foregoing description but only by the scope and spirit of the appended claims.

What is claimed is:

1. A reinforcing member for a badminton racquet wherein the racquet extends along a longitudinal axis and includes a frame having a tubular hoop portion supporting a string bed and a tubular handle portion, the reinforcing member comprising:

a generally T-shaped body including, a first section having an outer surface, the outer surface defining a first cross-sectional area measured about a longitudinal plane positioned generally perpendicular to the string bed, and a second section longitudinally and outwardly extending from the first section, the second section having an outer surface that defines a second cross-sectional area measured about a transverse plane, the first and second sections configured for placement within the hoop and handle portions of the frame, respectively, the first cross-sectional area being at least 50 percent greater than the second cross-sectional area.

2. The reinforcing member of claim 1, wherein the first cross-sectional area is at least 100 percent greater than the second cross-sectional area.

3. The reinforcing member of claim 1, wherein the body is hollow.

4. The reinforcing member of claim 1, wherein the body has a continuous, substantially solid construction.

5. The reinforcing member of claim 1, wherein the first section has left and right ends and a first length measured from the left end to the right end, wherein the second section has a second length measured along the longitudinal axis, and wherein the first length is at least 30 percent greater than the second length.

6. The reinforcing member of claim 5, wherein the first length is at least 50 percent greater than the second length.

7. A badminton racquet comprising:

a frame including a tubular hoop portion and a tubular handle portion;

a string bed supported by the hoop portion; and a generally T-shaped reinforcing member including, a first section having an outer surface, the outer surface defining a first cross-sectional area measured about a longitudinal plane positioned generally perpendicular to the string bed, and a second section longitudinally and outwardly extending from the first section, the second section having an outer surface that defines a second cross-sectional area measured about a transverse plane, the first cross-sectional area being at least 50 percent greater than the second cross-sectional area, the first and second sections configured for placement within the hoop and handle portions of the frame, respectively.

8. The badminton racquet of claim 7, wherein the hoop portion includes a recess, and wherein the reinforcing member includes an outwardly extending ledge sized to engage the recess.

9. The badminton racquet of claim 7, wherein the radial cross-sectional area of the hoop portion is greatest at or adjacent the location where the hoop portion connects to the handle portion.

10. The badminton racquet of claim 7, wherein the first cross-sectional area is at least 100 percent greater than the second cross-sectional area.

11. The badminton racquet of claim 7, wherein the reinforcing member is hollow.

12. The badminton racquet of claim 7, wherein the reinforcing member has a continuous solid construction.

13. The badminton racquet of claim 7, wherein the first section includes at least two spaced-apart racquet string holes.

14. The badminton racquet of claim 7, wherein the reinforcing member is formed of a carbon-fiber composite material.

15. The badminton racquet of claim 7, wherein the reinforcing member is formed of a material selected from the group consisting of non-carbon fiber composite materials, aluminum, polyurethane, nylon, a polymeric material and combinations thereof.

16. The badminton racquet of claim 7, wherein the first section has left and right ends and a first length measured from the left end to the right end, wherein the second section has a second length measured along the longitudinal axis, and wherein the first length is at least 30 percent greater than the second length.

17. The badminton racquet of claim 16, wherein the first length is at least 50 percent greater than the second length.

18. A badminton racquet extending along a longitudinal axis and, the racquet configured for impacting a shuttlecock and for placement within a test support for a torsional stability test, the racquet comprising:

a frame including a tubular hoop portion defining a hoop and a tubular handle portion, the frame having a head size of approximately 54.5 inches$^2$, the handle portion having a distal end region having an outside diameter within the range of 6.75 mm to 7.25 mm;

a string bed supported by the hoop portion, the racquet having a strung weight within the range of 88.0 to 93.5 grams; and a generally T-shaped reinforcing member including, a first section, and a second section longitudinally and outwardly extending from the first section, the first and second sections configured for placement within the hoop and handle portions of the frame, respectively, the racquet having a torsional deflection of less than 10.5 degrees when measured in a torsional stability test wherein the handle portion is fixedly supported by the test support, and the shuttlecock traveling at an incoming velocity of approximately 34 miles per hour impacts the string bed at a location approximately 1.25 inches to the left or right of a geometric center of the hoop portion.

19. The badminton racquet of claim 18, wherein a distal end region having an outside diameter within the range of 6.95 to 7.05 mm.

20. The badminton racquet of claim 19, wherein the torsional deflection of the racquet is less than 10 degrees when measured in the torsional stability test.

21. The badminton racquet of claim 18, wherein the strung weight of the racquet is within the range of 89 to 92 grams.

22. The badminton racquet of claim 18, wherein the torsional deflection of the racquet is less than 10 degrees when measured in the torsional stability test.

23. The badminton racquet of claim 18, wherein the torsional deflection of the racquet is less than 9.5 degrees when measured in the torsional stability test.

24. The badminton racquet of claim 18, wherein the first and second sections each have an outer surface, wherein the outer surface of the first section defines a first cross-sectional area measured about a longitudinal plane positioned generally perpendicular to the string bed, wherein the outer surface of the second section defines a second cross-sectional area measured about a transverse plane, and wherein the first cross-sectional area is at least 50 percent greater than the second cross-sectional area.

25. The badminton racquet of claim 24, wherein the first cross-sectional area is at least 100 percent greater than the second cross-sectional area.

26. The badminton racquet of claim 18, wherein the reinforcing member is hollow.

27. The badminton racquet of claim 18, wherein the reinforcing member has a continuous solid construction.

28. The badminton racquet of claim 18, wherein the first section has left and right ends and a first length measured from the left end to the right end, wherein the second section has a second length measured along the longitudinal axis, and wherein the first length is at least 30 percent greater than the first length.

* * * * *